US006804362B1

(12) United States Patent
Zimmermann et al.

(10) Patent No.: US 6,804,362 B1
(45) Date of Patent: Oct. 12, 2004

(54) ELECTROSTATIC AND ELECTROLYTIC LOUDSPEAKER ASSEMBLY

(76) Inventors: Claus Zimmermann, 30851 W. Agoura Rd., Suite 305, Westlake Village, CA (US) 91301; Robert E. Evans, 12128 Sprecher Ave., Cleveland, OH (US) 44135

( * ) Notice: Subject to any disclaimer, the term of this patent is extended or adjusted under 35 U.S.C. 154(b) by 177 days.

(21) Appl. No.: 10/266,158

(22) Filed: Oct. 8, 2002

(51) Int. Cl.[7] ..... H04R 25/00
(52) U.S. Cl. ..... 381/152; 381/174; 381/431
(58) Field of Search ..... 381/152, 173, 381/174, 176, 190, 191, 431; 181/173, 199

(56) References Cited

U.S. PATENT DOCUMENTS 5,392,358 A * 2/1995 Driver ..... 381/191
6,249,586 B1 * 6/2001 Stoffel et al. ..... 381/174
6,304,661 B1 * 10/2001 Azima et al. ..... 381/152
6,546,106 B2 * 4/2003 Azima ..... 381/152

* cited by examiner

*Primary Examiner*—Suhan Ni
(74) *Attorney, Agent, or Firm*—Albert O. Cota

(57) ABSTRACT

An advanced design for an electrostatic and an electrolytic loudspeaker assembly (10) that comprises a compound diaphragm (12) sandwiched between a first metal stator (40) and a second metal stator (60), wherein each stator includes a multiplicity of perforations (41,61). All the sides of the stators (40,60) as well as the inside surface of the perforations (41,61) are coated with an insulating material (90) also known as ACOUSTAGUARD™ (90) which includes a base coat (92) and a sealing and pigmentation coat (94). The coats (92) and (94) are applied by a unique process that allows ACOUSTAGUARD™ to be applied at room temperature by preferably a spraying technique. The application of ACOUSTAGUARD™ avoids any arcing or corona discharge between the two stators (40,60) which can distort the audio output and damage the loudspeaker assembly (10).

19 Claims, 3 Drawing Sheets

ELECTROSTATIC AND ELECTROLYTIC LOUDSPEAKER ASSEMBLY

TECHNICAL FIELD

The invention pertains to the general field of relatively thin electrostatic and electrolytic loudspeaker asesmblies and more particularly to a loudspeaker assembly that features an insulating material and a process for applying the insulating material to a pair of metal stators incorporated into the loudspeaker assembly.

BACKGROUND ART

The use of electrostatic and electrolytic loudspeakers has become widespread as a result of their high-quality performance and relative thinness which allows unique design and loudspeaker attachment configurations.

Electrostatic and electrolytic loudspeakers are designed to utilize a central diaphragm that is sandwiched between a first metal stator and a second metal stator. Between the two stators can exist a large difference in electrical Potential. Thus, it is necessary to insulate the respective stators to avoid arcing and corona discharge, both of which can adversely affect the audio output and may damage the speaker.

The insulation of the stators has always been a problem because of the difficulty in locating a suitable insulating material and a practical and cost-effective process for applying the material to the stators. This problem is solved by the instant invention by using a unique insulating material that is applied by a cost-effective process to the stators.

A search of the prior art did not disclose any patents or industry literature that read upon the claims of the insulating material. However, the following U.S. patents are related to electrostatic and electrolytic loudspeaker assemblies:

| PATENT NO. | INVENTOR | ISSUED |
|---|---|---|
| 5,392,358 | Driver | 21 Feb. 1995 |
| 3,892,927 | Lindenberg | 1 Jul. 1975 |

The U.S. Pat. No. 5,392,358 patent discloses an electrolytic loudspeaker assembly that reproduces a broad band of audio signals and that consists of a thin, non-magnetic capacitive transducer and a transducer drive unit. The transducer consists of a compound diaphragm further consisting of a vibratory center section having attached to each of its surfaces a respective front section and back section. All three sections of the compound diaphragm are held captive by a frame assembly. The transducer is driven and controlled by the transducer driver unit. The unit couples the audio signal to the transducer's front and back sections and supplies an unregulated d-c bias voltage to the transducer's center section. The unit maintains the proper ratio between the bias voltage and audio signal to achieve optimum performance.

The U.S. Pat. No. 3,892,927 patent discloses a single diaphragm, electrostatic loudspeaker having multiple opposing pairs of electrodes which are graded in size. The speaker further includes means for electrically controlling the high frequency response of each electrode pair so as to achieve an overall uniform response. The diaphragm is acoustically damped and selectively tuned by mass loading to achieve inertia control below a designated frequency, thus extending the loudspeaker's useful response into the low frequency range.

Note, the U.S. Pat. No. 5,392,358 Driver patent is assigned to MZX, Incorporated. Mr. Claus Zimmermann is the president of MZX Incorporated and is also one of the applicants of the instant application.

DISCLOSURE OF THE INVENTION

The invention is comprised of a relatively thin electrostatic or electrolytic loudspeaker assembly that utilizes a unique insulating material and a unique process for applying the material to a pair of metal stators that are utilized in the construction of the loudspeaker assembly.

In its most basic form, the electrostatic or electrolytic loudspeaker assembly is comprised of:

A. A central compound diaphragm having a first side, a second side, and a center electrode.

B. A front section incorporating an electrically insulated first dielectric spacer that interfaces with the first side of the diaphragm and with an electrically insulated first metal stator having attached a front electrode.

C. A rear section incorporating an electrically insulated second dielectric spacer that interfaces with the second side of the diaphragm and with an electrically insulated second metal stator having attached a rear electrode.

D. A frame dimensioned to enclose and suspend the compound diaphragm, the front section and the rear section.

E. A loudspeaker assembly driver having means for receiving and making electrical contact with the center, front and rear electrodes. The driver also has circuit means for receiving and processing an audio signal that causes the diaphragm to produce an audio input that follows the excursions of the audio signal.

The first and second stators are preferably made of metal, such as aluminum or steel. Alternatively, the stators can be made of a plastic that interfaces with a metallized, electrically-conductive layer. In either case, the stators include a multiplicity of perforations.

When the loudspeakers are operating, there exists a relatively large difference in electrical potential between the two stators. This difference in electrical potential can cause arcing and/or a corona discharge between the two stators which can impair the audio output and that may also damage the loudspeaker.

To solve the arcing and/or corona discharge problem, all the stator surfaces, including the inside surface of the perforations, are coated with a two-part electrically insulating system referred to as ACOUSTAGUARD™.

The first part, which consists of a base coating, is comprised of a cured elastomer classified under the chemical family of polyurethanes, and is maintained and applied directly to the stators at room temperature by spraying or brushing.

The second part, which consists of a sealing and color pigmentation coating material, is comprised of a catalyzed pigmented material which includes a solvent selected from a group of solvents consisting of methylene chloride, perchorethylene and trichlorethylene.

The second part is also maintained and applied at room temperature by spraying or brushing onto the base coating.

The two-part ACOUSTAGUARD™ system is flexible, durable, and accommodates a wide range of colors.

In view of the above disclosure, the primary object of the invention is to:

1) provide an advanced design for an electrostatic and an electrolytic loudspeaker assembly that does not require a separate cable to connect the assembly to a wall outlet or to an external power supply to produce a bias voltage required to operate the assembly, and 2) to disclose an insulating material and process for applying the material to a pair of stators used in the design of the loudspeaker assembly.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
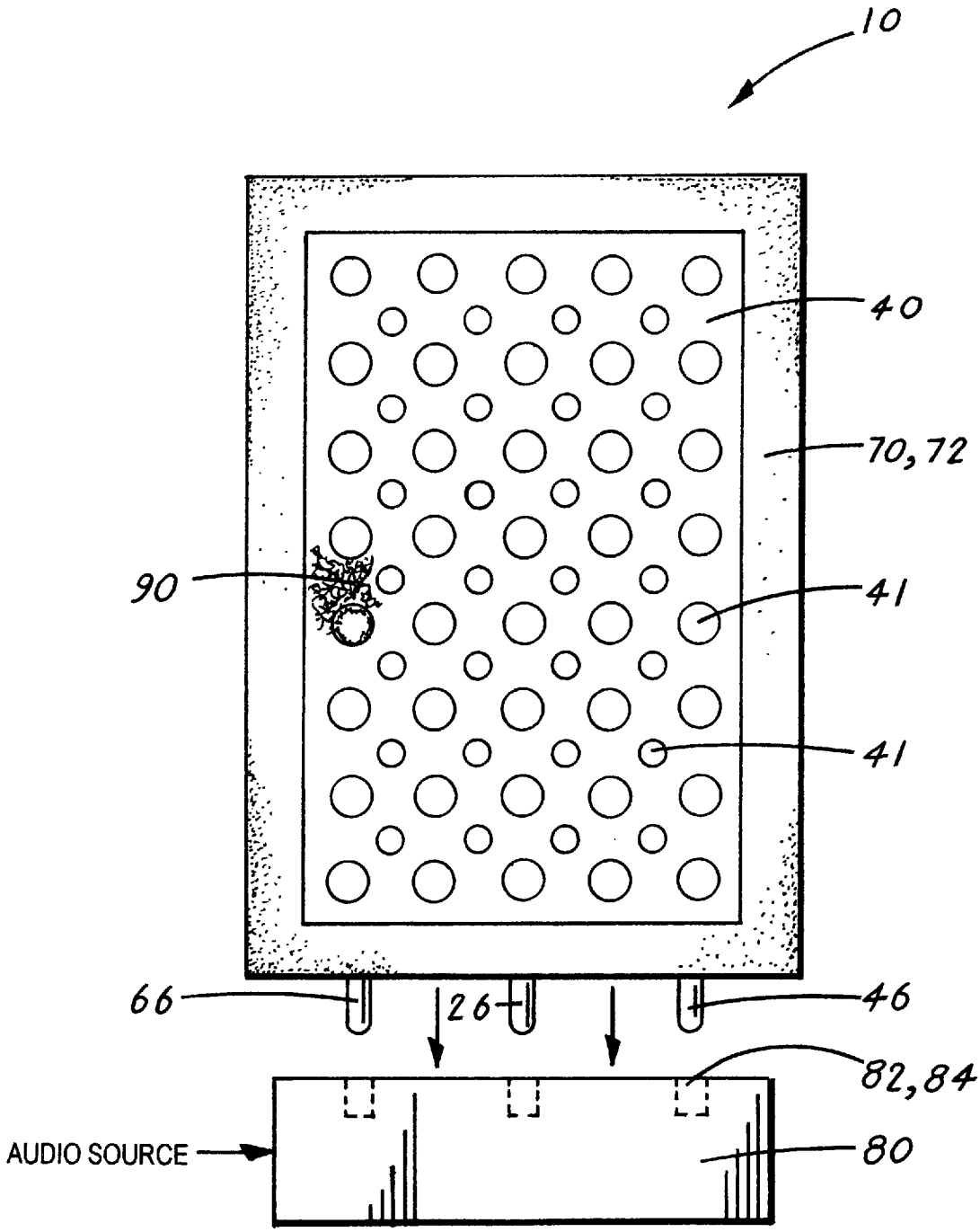
FIG. 1 is a front elevational view of an electrostatic or electrolytic loudspeaker assembly showing a set of electrodes that make electrical contact with a loudspeaker driver that is connected to an audio source.

The best mode for carrying out the invention is presented in terms of a preferred embodiment for an electrostatic or an electrolytic loudspeaker assembly 10.

The assembly 10 is shown in FIGS. 1–5, and is comprised of the following major elements: a central compound diaphragm 12, a front section 30, a rear section 50, a frame assembly 70, a loudspeaker driver 80 and an electrically insulating material 90.

Figure 2:
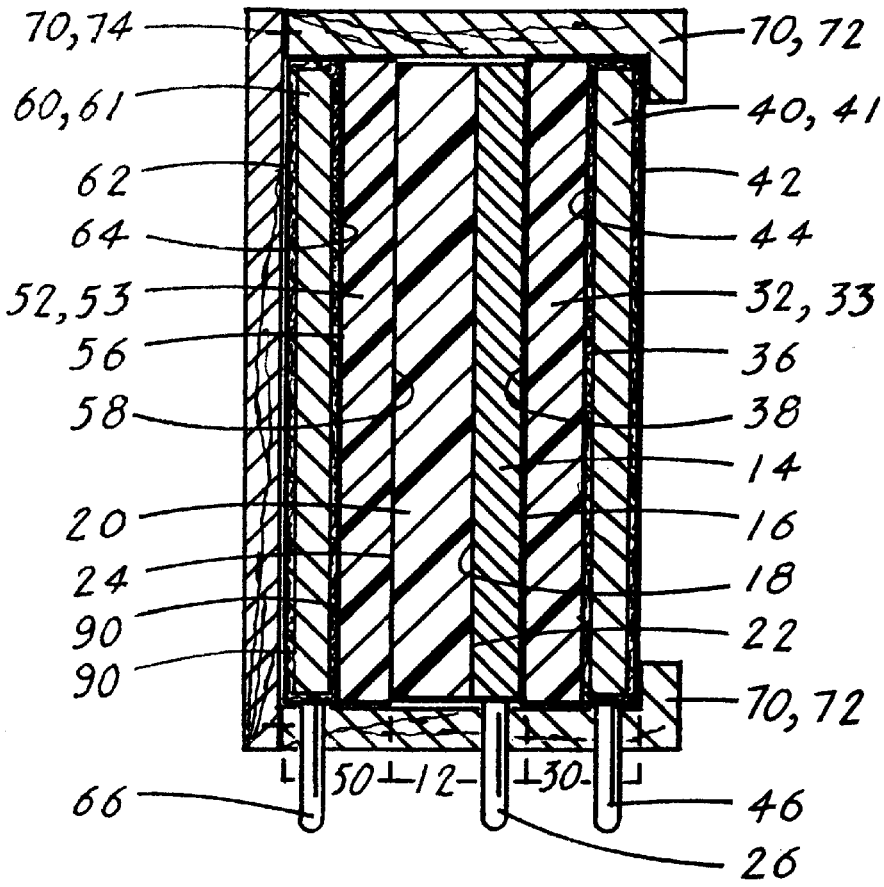
FIG. 2 is a cross-sectional side view of an electrostatic or electrolytic loudspeaker assembly. The assembly is shown enclosed within a frame with a central compound diaphragm sandwiched between a front section and a rear section.

The central compound diaphragm 12, as shown in FIG. 2, is comprised of three elements: an electrically-conductive layer 14 having a first side 16 and a second side 18, a flexible membrane 20 having a first surface 22, a second surface 24, and a center electrode 26.

As shown in FIG. 2, the first surface 22 of the flexible membrane 20 interfaces with the second side 18 of the electrically-conductive layer 14. The interface is preferably accomplished by directly depositing the electrically-conductive layer 14 onto the flexible membrane 20 by utilizing a metal depositing or metal evaporating technique. The flexible membrane 20 can be comprised of a thermoplastic selected from the group consisting of MYLAR®, TEONEX® and KALADEX®. The center electrode 26, as also shown in FIG. 1, is in electrical contact with the electrically-conductive layer 14 of the compound diaphragm 20.

The front section 30, as shown in FIG. 2, is comprised of three elements: an electrically insulated first dielectric spacer 32 having a first side 36 and a second side 38, a first electrically insulated metal stator 40 having a first surface 42 and a second surface 44, and a front electrode 46.

Figure 3:
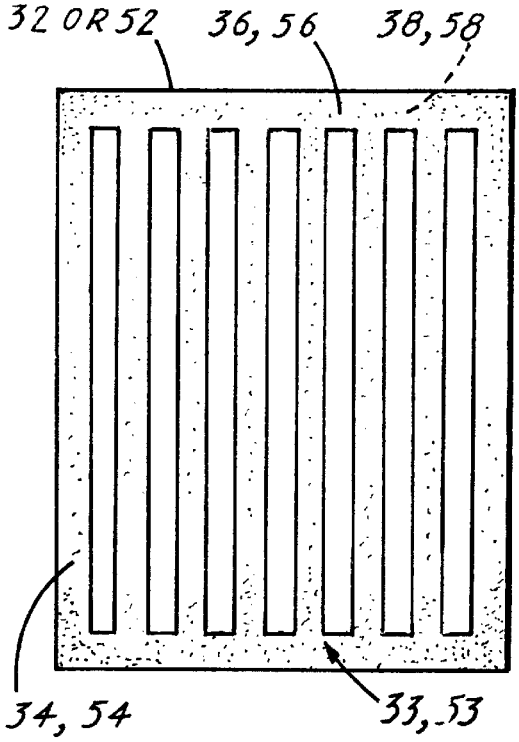
FIG. 3 is a front elevational view of dielectric spacer having a typical grid pattern.

As shown in FIGS. 1 and 2, the first dielectric spacer 32 has a grid pattern 33 which is bordered by a perimeter edge 34 that is dimensioned to substantially encompass the outer perimeter of the compound diaphragm 12. The grid pattern 33 can consist of various designs including diagonal sections, horizontal sections and vertical sections as illustrated in FIG. 3. The second side 38 of the spacer 32 interfaces with the first side 16 of the electrically-conductive layer 14. The interface can be accomplished by making the first dielectric spacer 32 out of a double-sided adhesive foam or other non-conducting material.

Figure 4:
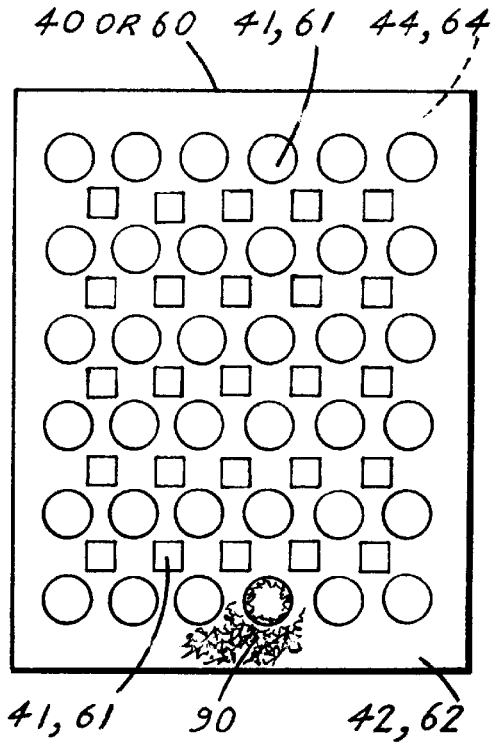
FIG. 4 is a front elevational view of a metal stator having a typical perforated pattern.
Figure 5:
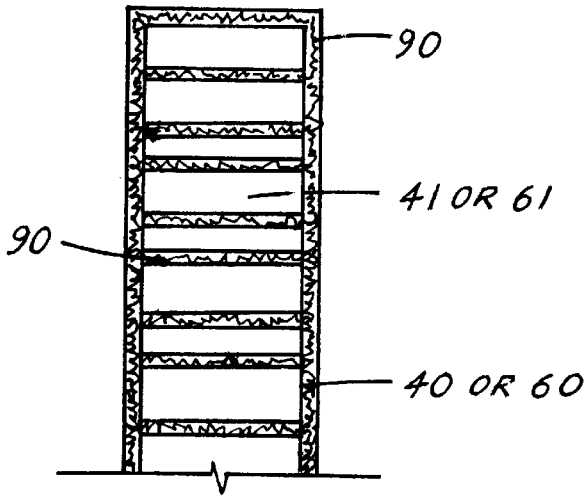
FIG. 5 is a cross-sectional side view of a metal stator having its surfaces, including the inside surface of the perforations, coated with an insulating material also referred to as ACOUSTAGUARD™.

The first metal stator 40, as shown in FIGS. 1, 2 and 4, includes a multiplicity of perforations 41 which can form a specific pattern or be randomly located. The stator, as best illustrated in FIG. 2, includes a first surface 42 and a second surface 44. The second surface is dimensioned to interface with the first side 36 of the first dielectric spacer 32. The first metal stator 40, which is constructed of a metal such as aluminum or steel, has attached a front electrode 46, as shown in FIGS. 1 and 2. All the surfaces of the first metal surface 40, including the inside of the perforations 41, are coated with the electrically insulating material 90 as best shown in FIGS. 2 and 5. The material 90 is disclosed infra.

The rear section 50, as also shown in FIG. 2, is also comprised of three elements: an electrically insulated second dielectric spacer 52 having a first side 56 and a second side 58, an electrically insulated second metal stator 60 having a first surface 62 and a second surface 64, and a rear electrode 66. The structure of the rear section 50 is identical in form and function as the front section 30, however for clarity its structure and function are substantially repeated with the corresponding reference designators.

As shown in FIGS. 1 and 2, the second dielectric spacer 52 has a grid pattern 53 which is bordered by a perimeter edge 54 that substantially encompasses the outer perimeter of the compound diaphragm 12. The second side 58 of the spacer 52 interfaces with the second surface 24 of the flexible membrane 20 that is a part of the compound diaphragm 12, as shown in FIG. 2.

The second metal stator 60, as shown in FIGS. 2 and 4, includes a multiplicity of perforations 61 which can form a specific pattern or be randomly located. The stator, as best shown in FIG. 2, includes a first surface 62 and a second surface 64. The second surface 64 is dimensioned to interface with the first side 56 of the second dielectric spacer 52. The second metal stator 60, as also shown in FIG. 2, is in electrical contact with the rear electrode 66. All the surfaces of the second metal stator 60, including the inside of the perforations 61, are also coated with the electrically insulating material 90.

The frame assembly 70, as shown in FIGS. 1 and 2, can be constructed of wood, plastic, metal or any other applicable material and is comprised of a front structure 72 and a rear structure 74. The two structures are held together by an attachment means 76 that can consist of various fasteners, snaps or an adhesive. The frame assembly 70 is dimensioned to hold the compound diaphragm 12, the front section 30 and the rear section 50.

The final element that comprises the electrostatic and electrolytic loudspeaker assembly is the loudspeaker driver 80, as shown in block form in FIG. 1. The driver 80 is designed to interface with the compound diaphragm 12, the front section 30 and the rear section 50 by an attachment means 82.

The insulating material 90, which is also referred to as ACOUSTAGUARD™ 90, and the process for applying ACOUSTAGUARD™ to the first and second metal stators 40,60 is next disclosed. The ACOUSTAGUARD™ 90, which consists of a base coat 92 and a sealing and pigmentation coat 94, is applied to all the surfaces of the two stators, including the inside of the multiplicity of perforations, in a thickness to preclude arcing or corona discharge when electrical energy is applied across the stators.

The base coat 92 is comprised of a cured elastomer that is classified under the chemical family of polyurethanes. A typical formulation comprises:

a) 35–60% Dihydro-2 (3H-furanone)

b) 26–52% Methylene Dianiline (ACGIH)

c) 0.13–0.57% Methylene bis (cyclohexyliso-cyanate), and d) 3.4–5.7% Dischloromethane.

The base coat 92 also exhibits the following characteristics:

a) appearance—solid, b) specific gravity—1.05 to 1.26, c) odor—none, d) stability—stable, e) hazardous ingredients—none, and f) can be mixed and applied at room temperature.

The process for applying ACOUSTAGUARD™ base coat 92 to the first and second stators 40,60 is comprised of the following steps:

a) Heat the first and the second stators 40,60 to a temperature of 600±10° F. for a time period between 50 to 70 minutes.

b) Cool the stators 40,60 to room temperature, c) Blast the stators with a blast media from all sides at a pressure of 50±5 PSI and at an angle of 45±5°.

d) Apply a stream of clean air to the stators to remove any blast media residue.

e) Apply a coating of the ACOUSTAGUARD™ base coat 92 to all sides of the stators at a pressure of 3000±200 PSI and at an angle of 45±5° so that a dry film thickness (DFT) of 3–4 mils is produced.

f) Repeat step e) three additional times, rotating the stators 90° for each subsequent coat.

g) Apply a fifth coating to all sides of the stators at an angle of 90°, h) Cure the stators for a period of 2–8 hours at room temperature, and i) visually inspect and electrically test the stators to a minimum of 20 KV.

The blast media referred to in step c) is comprised of:

a) 85% staurolite-iron aluminum silicate hydroxide, ($Fe_2AlgS_{14}O_{22}(OH)_2$,)

b) 7% Titanium minerals, c) <5% Quartz, d) 3% Zircon, and e) 2% Kyanite.

The sealing and pigmentation coat 94 is comprised of a catalyzed pigmented material which includes a solvent that is selected from a group of solvents consisting of methylene chloride, perchorethylene, and trichlorethylene. If a specific color is desired, such as to match the decor of a room where the loudspeaker(s) is to be installed, that color can be achieved through the application of an appropriate pigmentation. A typical formulation of the sealing and pigmentation coat 94 comprises:

a) Cyclohexanone: 15–30%, b) Talc: 5–20%, c) N-Butyl Acetate: 13–15%.

d) Nickel Antimoney Titanale 0.22%, and e) Titanium Dioxide or Carbon Black 0–30% depends upon the color selected.

The coat 94 also exhibits the following characteristics:

a) Appearance: Solid, b) Specific Gravity: 1.05–1.3, c) Odor: None, d) Stability: Stable, e) Lead Content: None and f) Can be made in any color and applied at room temperature.

The process for applying the sealing and pigmentation coat 94, after the application of the base coat 92, to the first and second stator 40,60 is comprised of the following steps that continue after step i) of the above process.

j) if the stators satisfactorily pass the test in subparagraph i), apply the final coating twice in each of five 72°±5° increments around the stators for a total of ten (10) applications, and k) cure said stators for a period of 24±1 hours, and l) visually inspect and electrically retest the stators to a mimumum of 20 KV.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

What is claimed is:

1. An electrostatic or electrolytic loudspeaker assembly comprising:

a) a central compound diaphragm comprising:

(1) an electrically-conductive layer having a first side and a second side, (2) a flexible membrane having a first surface and a second surface, wherein the first surface interfaces with the second side of said electrically-conductive layer, (3) a center electrode in electrical contact with the electrically-conductive layer, b) a front section comprising:

(1) a first dielectric spacer having a grid pattern, which is bordered by a perimeter edge that is dimensioned to substantially encompass the outer perimeter of said compound diaphragm, a first side and a second side, wherein the second side interfaces with the first side of the electrically-conductive layer, (2) a first electrically insulated metal stator having a multiplicity of perforations, a first surface and a second surface, wherein the second surface interfaces with the first side of the first dielectric spacer, (3) a front electrode in electrical contact with said first metal stator, c) a rear section comprising:

(1) a second dielectric spacer having a grid pattern which is bordered by a perimeter edge, that is dimensioned to substantially encompass the outer perimeter of said compound diaphragm, a first side and a second side, wherein the second side interfaces with the second surface of the flexible membrane, (2) a second metal stator having a multiplicity of perforations, a first surface and a second surface, wherein the second surface interfaces with the first side of the second dielectric spacer, (3) a rear electrode in electrical contact with said second metal stator, d) a frame assembly comprising:

(1) a front structure, and (2) a rear structure that when attached to the front structure, by an attachment means, said central compound diaphragm, said front section, and said rear section are captively suspended within said frame assembly, and e) a loudspeaker driver having circuit means for:

(1) interfacing with said compound diaphragm, said front section and said rear section by means of said center, front and rear electrodes, (2) receiving and processing an audio signal, (3) producing and applying a bias voltage to said compound diaphragm, and (4) producing and applying an alternating signal corresponding to the audio signal across said first and said second metal stators, which causes said diaphragm to be driven in a push-pull relation in .accordance with the excursions of the audio signal.

2. The assembly as specified in claim 1 wherein said electrically-conductive layer is applied by a metal depositing or metal evaporating process.

3. The assembly as specified in claim 2 wherein said flexible membrane is comprised of a thermoplastic selected from the group consisting of MYLAR®, TEONEX® and KALADEX®.

4. The assembly as specified in claim 2 wherein said first and said second dielectric spacers are comprised of a double-sided adhesive foam.

5. The assembly as specified in claim 4 wherein said first and said second metal stators are comprised of aluminum.

6. The assembly as specified in claim 4 wherein said first and said second metal stators are comprised of steel.

7. The assembly as specified in claim 1 further comprising an insulating material, also referred to as ACOUSTAGUARD™, and a process for applying the insulating material to said first metal stator and said second metal stator, wherein said insulating material is comprised of a base coat and a sealing and pigmentation coat.

8. The assembly as specified in claim 7 wherein said insulating material is applied to the first surface, the second surface and the inside surface of the multiplicity of stator perforations.

9. The assembly as specified in claim 8 wherein said insulating material is applied in a thickness to preclude arcing or a corona discharge between said first and said second stators when electrical energy is applied across said stators.

10. The assembly as specified in claim 9 wherein said base coat is comprised of a cured elastomer classified under the chemical family of polyurethanes.

11. The assembly as specified in claim 10 wherein a typical formulation of said base coat comprises:

a) 35–60% Dihydro-2 (3H-furanone)

b) 26–52% Methylene Dianiline (ACGIH)

c) 0.13–0.57% Methylene bis (cyclohexyliso-cyanate), and d) 3.4–5.7% Dichloromethane.

12. The assembly as specified in claim 11 wherein said base coat exhibits the following physical characteristics:

a) appearance—solid, b) specific gravity—1.05 to 1.26, c) odor—none, d) stability—stable, e) hazardous ingredients—none, and f) can be mixed and applied at room temperature.

13. The assembly as specified in claim 7 wherein said process for applying said base coat to said first and second stators comprises the following steps:

a) heat said first and said second stators to a temperature of 600±10° F. for a time period between 50 to 70 minutes, b) cool said stators to room temperature, c) blast said stators with a blast media from all sides at a pressure of 50±5 PSI and at an angle of 45±5°, d) apply a stream of clean air to said stators to remove any blast media residue, e) apply a coating of said base coat to all sides of said stators at a pressure of 3000±200 PSI and at an angle of 45±5° so that a dry film thickness (DFT) of 6–8 mils is produced, f) repeat step e) three additional times, rotating said stators 90° for each subsequent application of said base coat, g) apply a fifth coating of said base coat to all sides of said stators at an angle of 90°, h) cure said stators for a period of 2–8 hours at room temperature, and i) visually inspect and electrically test said stators to a minimum of 20 KV.

14. The assembly as specified in claim 13 wherein said blast media comprises:

a) 85% staurolite-iron aluminum silicate hydroxide, ($Fe_2AlgS_{14}O_{22}(OH)_2$,)

b) 7% Titanium minerals, c) <5% Quartz, d) 3% Zircon, and e) 2% Kyanite.

15. The assembly as specified in claim 7 wherein said process for applying said sealing and pigmentation coat to said first and second stators comprises the following steps:

a) heat said first and said second stators to a temperature of 600±10° F. for a time period between 50 to 70 minutes, b) cool said stators to room temperature, c) blast said stators with a blast media from all sides at a pressure of 50±5 PSI and at an angle of 45±5°, d) apply a stream of clean air to said stators to remove any blast media residue, e) apply a coating of said base coat to all sides of said stators at a pressure of 3000±200 PSI and at an angle of 45±5° so that a dry film thickness (DFT) of 6–8 mils is produced, f) repeat step e) for three additional times, rotating said stators 90° for each subsequent coating of said base coat, g) apply a fifth coating of said base coat to all sides of said stators at an angle of 90°, h) cure said stators for a period of 2–8 hours at room temperature, i) visually inspect and electrically test said stators for a minimum of 20 KV, j) prepare a coating of a catalyzed pigmented material which includes a solvent that is selected from the group of solvents consisting of methylene chloride, perchorethylene, and trichlorethylene, k) apply said coating twice in each of five 72°±5° increments around said stators for a total of ten (10) applications, l) cure said stators for a period of 24±1 hours, and m) visually inspect and electrically retest said stators to a minimum of 20 KV.

16. The assembly as specified in claim 15 wherein said blast media comprises:

a) 85% staurolite-iron aluminum silicate hydroxide, ($Fe_2AlgS_{14}O_{22}(OH)_2$, )

b) 7% Titanium minerals, c) <5% Quartz, d) 3% Zircon, and e) 2% Kyanite.

17. The assembly as specified in claim 15 wherein said pigment in said catalyzed pigmented material can be selected to provide a specified color.

18. The assembly as specified in claim 15 wherein said sealing and pigmentation coat comprises:

a) Cyclohexanone: 15–30%, b) Talc: 5–20%, c) N-Butyl Acetate: 13–15%.

d) Nickel Antimoney Titanale 0.22% and e) Titanium Dioxide or Carbon Black 0–30% depends upon the color selected.

19. The assembly as specified in claim 18 wherein said sealing and pigmentation coat exhibits the following characteristics:

a) Appearance: Solid, b) Specific Gravity: 1.05–1.3, c) Odor: None, d) Stability: Stable, e) Lead Content: None, and f) Can be made in any color and applied at room temperature.

* * * * *